United States Patent [19]

Goseberg et al.

[11] 4,406,978

[45] Sep. 27, 1983

[54] HORIZONTAL DEFLECTION OUTPUT TRANSFORMER FOR A TELEVISION RECEIVER

[75] Inventors: Walter Goseberg; Alfred Pollak; Wolfgang Reichow, all of Hanover, Fed. Rep. of Germany

[73] Assignee: Licentia Patent-Verwaltungs-GmbH, Frankfurt am Main, Fed. Rep. of Germany

[21] Appl. No.: 226,612

[22] Filed: Jan. 21, 1981

[30] Foreign Application Priority Data

Jan. 21, 1980 [DE] Fed. Rep. of Germany ..... 3001975

[51] Int. Cl.[3] ..... H01J 29/70

[52] U.S. Cl. ..... 315/411; 336/185; 363/126

[58] Field of Search ..... 315/411; 363/20, 68, 363/126; 336/185, 199

[56] References Cited

U.S. PATENT DOCUMENTS

| | | | |
|---|---|---|---|
| 1,129,474 | 2/1915 | Fortescue | 336/182 X |
| 1,898,931 | 2/1933 | Bahrmann | 336/185 X |
| 1,912,389 | 6/1933 | Smith | 336/185 X |
| 2,116,404 | 5/1938 | Montsinger | 336/185 X |
| 3,546,580 | 12/1970 | Williams | 336/180 X |
| 3,657,632 | 4/1972 | Miyoshi | 363/126 X |
| 3,813,574 | 5/1974 | Sato | 315/411 X |
| 3,904,928 | 9/1975 | Sawada et al. | 336/185 X |
| 3,936,719 | 2/1976 | Miyoshi et al. | 363/126 |
| 3,947,749 | 3/1976 | Kimura et al. | 363/126 |
| 4,247,889 | 1/1981 | Riechmann | 315/411 X |

FOREIGN PATENT DOCUMENTS

| | | |
|---|---|---|
| 2332711 | 8/1974 | Fed. Rep. of Germany . |
| 2264451 | 2/1975 | Fed. Rep. of Germany . |
| 2607368 | 8/1977 | Fed. Rep. of Germany . |
| 2207386 | 6/1974 | France . |

OTHER PUBLICATIONS

Funktechnik, 1979, No. 4, pp. T183–184.

*Primary Examiner*—Richard A. Farley

*Attorney, Agent, or Firm*—Spencer, Kaye & Frank

[57] ABSTRACT

In a horizontal deflection circuit output transformer for a television receiver, which transformer includes a primary coil, a secondary coil inductively coupled to the primary coil, and a rectifier connected to the secondary coil and cooperating therewith to generate a high voltage for the picture tube, the secondary coil is divided into two partial windings and the rectifier is located physically between the partial windings.

22 Claims, 7 Drawing Figures

Fig.3
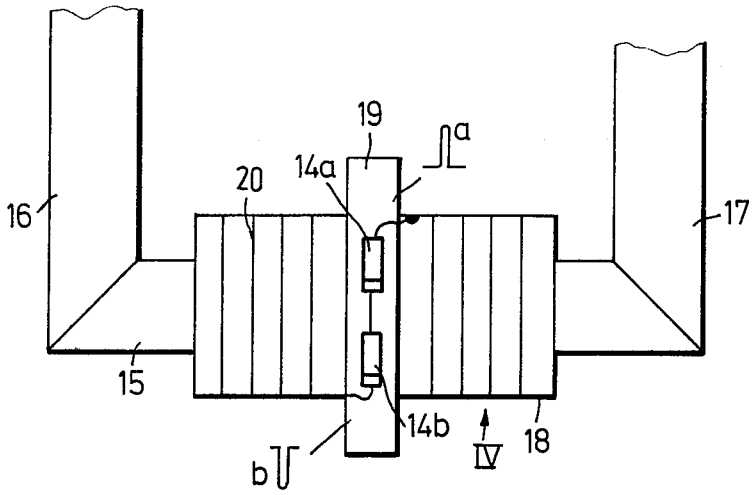
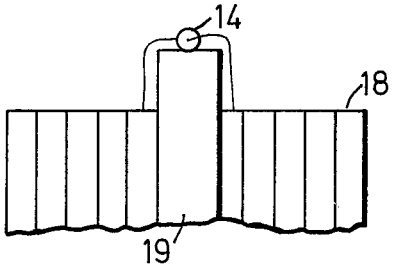
Fig.4
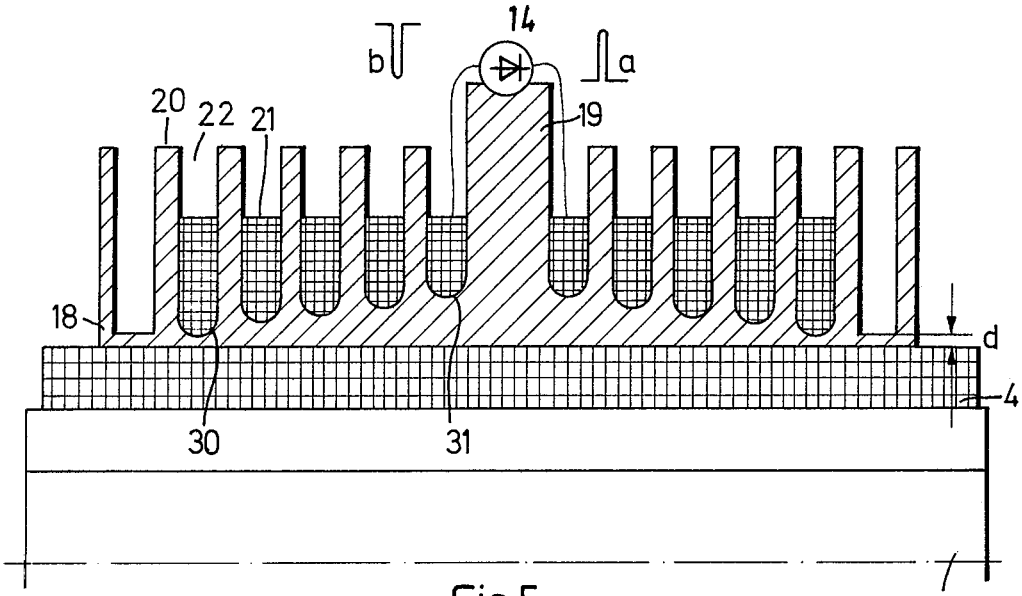
Fig.5

HORIZONTAL DEFLECTION OUTPUT TRANSFORMER FOR A TELEVISION RECEIVER

BACKGROUND OF THE INVENTION

The horizontal deflection circuit output transformer of a television receiver is known to generate inter alia by means of a high voltage coil and a high voltage rectifier, a high voltage of the order of magnitude of 25 KV for the picture tube. This voltage is obtained by rectifying the pulse-shaped flyback, or retrace, voltage produced in the transformer. Due to this high pulse-shaped voltage, the output transformer must meet especially high demands regarding its voltage stability since such high pulse voltages could easily lead to sparkovers and arc discharges.

Generally such a transformer includes a frame-shaped core having an air gap and, if it is designed as a singlearm transformer, the primary winding and the high voltage winding are arranged one on top of the other on the same arm of the core. For reasons of cost and weight, it is desirable to give the core the smallest possible dimensions. As a result, the high voltage coil takes up practically the entire length of an arm of the core, i.e., it extends up to the adjacent arms of the core which depart from this arm at a right angle. Particularly at a point where the end of the high voltage coil lies closely against an adjacent core arm, there also exists the high pulse voltage of the high voltage coil. For that reason, this point poses particular difficulties in realizing the required voltage stability.

Testing of such transformers is performed with a voltage exceeding rated voltage by 50%, in which case there appear even higher pulse voltages which reach an order of magnitude of 40 KV across the entire high voltage coil.

SUMMARY OF THE INVENTION

It is an object of the present invention to facilitate satisfaction of the voltage stability requirements of a transformer, particularly between the pulse-shaped voltage and the core of the transformer, even if the entire transformer is of a compact design.

The above and other objects are achieved, according to the invention, in a horizontal deflection circuit output transformer for a television receiver, which transformer includes a primary coil, a secondary coil inductively coupled to the primary coil, and a rectifier connected to the secondary coil and cooperating therewith to generate a high voltage for the picture tube, by dividing the secondary coil into two partial windings locating the rectifier physically between the partial windings.

One advantageous result of the invention is that the two extremities of the entire high voltage coil support no pulse voltage but are in effect free from alternating voltage. One end of the high voltage coil may be connected directly to ground. The other end of the high voltage coil, which is connected with the anode of the picture tube, also carries no pulse voltage due to the effect of the capacitance of the picture tube, but carries only the direct anode voltage for the picture tube. However, a direct voltage is much less critical than a pulse-shaped voltage with respect to voltage stability and the danger of sparkovers.

A significant advantage of the present invention is that the high pulse voltage which is unavoidable at the high voltage coil becomes effective to its full extent only in the center of the entire high voltage coil. At that location, the pulse voltage can be handled much better because the center of the high voltage coil is far removed from the two arms of the core which depart at right angles from the arm carrying the coil. In the present invention, therefore, the unavoidable maximum pulse voltage is spatially transferred to a point where it can be handled best.

Moreover, in the center of the high voltage coil additional structural measures can be employed at the coil form in order, for example, to make the distance of the high voltage rectifier from the core even greater. The coil form is preferably manufactured of polycarbonate resin marketed under the trademark Makrolon, a material which has a far better voltage stability than a cast mass.

The above-described subdivision of the high voltage coil and the diode connected therebetween leads to a positive symmetry of the high voltage coil. This reduces the necessary safety factor that is required for prior art transformers in dimensioning the diode blocking voltage. The above-mentioned positive symmetry in conjunction with freedom from alternating voltage in the ends of the windings leads to a minimum of interfering radiation from the high voltage coil.

In the so-called diode split transformer, described in the periodical Funktechnik [Radio Art] 1979, No. 4, pages T183–184, the high voltage coil is also divided into several partial windings between which high voltage rectifiers are disposed. But no use is made there of the solution provided by the present invention. Rather, the end of the high voltage coil facing the picture tube is not isolated with respect to alternating voltage, but carries a pulse voltage, which situation is avoided by the present invention.

BRIEF DESCRIPTION OF THE DRAWINGS

FIG. 3 is a simplified pictorial view of the basic structure of a coil form for a transformer according to a preferred embodiment of the invention.

FIG. 4 is a view similar to that of FIG. 3 taken in the direction of the arrow IV of FIG. 3.

FIG. 5 is a cross-sectional detail view, in the same plane as FIG. 4, of a coil form for a preferred embodiment of the invention.

DESCRIPTION OF THE PREFERRED EMBODIMENTS

Figure 1:
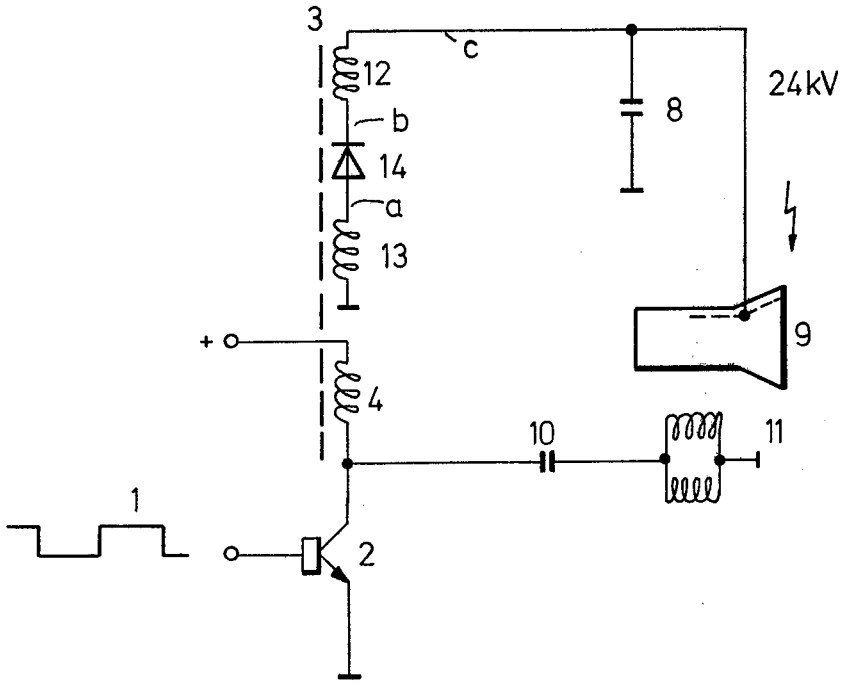
FIG. 1 is a basic circuit diagram of a circuit incorporating the transformer according to the invention.
Figure 2:
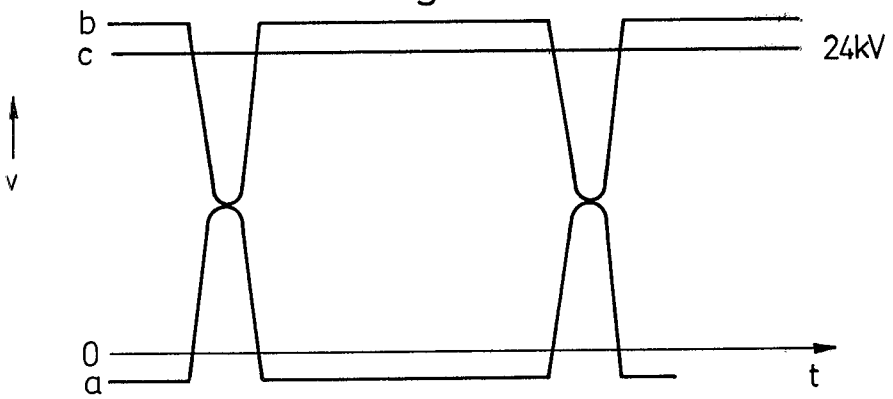
FIG. 2 is a diagram illustrating voltage waveforms existing in the circuit of FIG. 1.

The curves a, b and c of FIG. 2 show the waveforms of the voltage appearing and correspondingly designated points in the circuit of FIG. 1 and the structures of FIGS. 3 and 5.

FIG. 1 shows a horizontal deflection circuit output transistor 2 controlled by a horizontal deflection voltage 1, an output transformer 3 having a primary winding 4, a picture tube 9, a capacitor 8 formed essentially by the inherent capacitance of picture tube 9, a coupling capacitor 10 which also serves to promote deflection linearity, as well as horizontal deflection coils 11.

Transformer 3 further includes a high voltage coil for generating a high voltage of 24 KV for the picture tube 9. This coil is inductively coupled with primary 4 and is divided into two identical size partial windings 12 and 13 between which there is disposed a high voltage rectifier 14.

The operation of this device will be explained with reference to FIG. 2. The lower end of winding 13 is connected to ground and thus carries neither a direct voltage nor an alternating voltage. Therefore, no problems can arise at this end of the entire high voltage coil. Similarly, voltage pulses are not present at the upper end of the winding 12 because of the effect of the capacitor 8, so that only a pure direct high voltage is present across the picture tube 9, as shown at c. The voltage a which is essentially free of a direct voltage component, present at the upper end of the winding 13 contains pulses with an amplitude of, e.g., 12.5 KV. If the upper end of winding 13 carries pulses which are positive with respect to ground, the voltage b at the lower end of the winding 12 must contain pulses which are negative with respect to the normal voltage level if windings 12 and 13 have the same winding direction. The effect of the rectifier 14 is to prevent the voltage b from dropping below the voltage a. The result is that the pulse peaks of the voltage b are clamped onto the pulse peaks of the voltage a.

At the upper end of the winding 12 the effect of the capacitor 8 then produces the pure direct voltage c which constitutes the high voltage required for the picture tube 9. It can be seen that the voltages at the ends of the complete high voltage coil, i.e. the grounded lower end of the winding 13 and the high voltage upper end of the winding 12, advantageously contain no pulse voltage component. As shown in FIG. 2, such pulse voltage is advantageously present only in the center of the winding at the two ends of the rectifier 14.

FIG. 3 shows part of a frame-shaped, or rectangular, core structure with three of its arms 15, 16 and 17. The arm 15 carries a coil form 18 for the high voltage coil 12, 13, which is provided in the form of a chamber winding. The coil form 18 is generally cylindrical and includes chamber dividing, or partition, walls 20 of circular form. The coil windings 12 and 13 are wound around the axis of form 18, which is parallel to the axis of arm 15. All the partial windings 21 lying within the chambers 22 are wound one after another without any interruption of the wire. The wire is fed through slots within the walls forming the chambers 22. That means that all the partial windings 21 are series-connected without any interruption and form together the windings 12, 13 in FIG. 1.

In its center, the coil form 18 is provided with a wall 19 whose width, or thickness, and diameter are greater than those of the partition walls 20. For reasons of voltage stability, two series-connected rectifiers **14*a* and 14*b* are arranged upon the outer circumference of the wall 19. One end of the series connection of these two rectifiers is connected with the winding to the left of wall 19, which constitutes the partial winding 13, and the other end of the series connection is connected with the winding to the right of wall 19, which constitutes the partial winding 12. It can be seen that the rectifiers 14 across which occur the pulse components of voltages a and b, are now at a great distance from the core arms 16 and 17 and from the particularly troublesome corners between the arms 16 and 15 and 17 and 15**.

FIG. 4 is a bottom detail view of the arrangement of FIG. 3.

FIG. 5 shows in cross section one specific embodiment of the chamber winding of FIGS. 3 and 4, constructed to be matched in an advantageous manner to the voltage conditions of the pulse voltage. The primary 4 is disposed on the arm 15 of the transformer 3 and around it is mounted the form 18 for the two windings 12 and 13. The windings 12 and 13 are, as noted above, designed as chamber windings and each is composed of partial windings 21 which are distributed in the chambers 22 formed by the partition walls 20. As also shown in FIGS. 3 and 4, the further wall 19 is again provided in the center with the rectifier 14 or the series connection rectifiers **14*a* and 14*b* arranged at its circumference. The bottoms of the chambers 22 are rounded to form grooves 30. The avoidance of sharp corners at the bottoms improves the voltage stability of the transformer. The grooves 31 adjacent the wall 19** are given an even larger radius for the same purpose.

As already mentioned, the pulse voltage is zero at the left and right ends of the complete high voltage coil and increases toward its center. The radial thickness d of the coil form 18 at the bottom of each chamber 22 is selected on the basis of this fact in that the wall thickness d increases from both ends towards the center because there the pulse voltage has its maximum amplitude. The insulation between the individual partial windings 21 and the primary winding 4 or the core 15, respectively, is also adapted in an advantageous manner to the actual amplitudes of the effective pulse voltage. Said insulation is constituted by the bottom of coil form 18. The width of the insulation is about 2–3 mm for a pulse voltage amplitude of about 25 kV peak to peak.

In this way, it is possible to realize a particularly tight coupling between the high voltage coil and the primary 4. The result is a low stray inductance and the advantage of being able to tune the stray inductance to a high harmonic of the frequency of the retrace oscillation and thus realize a low internal resistance in the high voltage source.

The outer end chambers of form 18 are not provided with a partial winding 21 and can be used to make connections to the coil ends.

As shown in FIG. 5, the individual chambers 22 are filled to a different degrees with the partial windings 21. Such variations in filling likewise permit an influence on the stray inductance and thus tuning to a harmonic.

Figure 6:
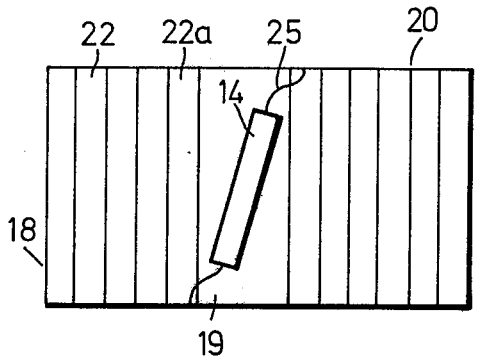
FIG. 6 is a view similar to that of FIG. 3 of a coil arrangement having a particular configuration.

FIG. 6 shows an embodiment in which the rectifier 14 is positioned in a particular manner at the outer circumference of the chamber wall 19, in that rectifier 14 is oriented obliquely with respect to the circumferential direction of the chamber wall 19. This orientation increases the distance between the connecting wire at each end of rectifier 14 and the chamber into which the wire at the other end of the rectifier extends. Thus, the connecting wire 25 of the rectifier 14 lies farther removed from the chamber **22*a* than if the rectifier 14 were oriented precisely in the circumferential direction of the chamber wall 19. The greatest danger of sparkover exists, in particular, between the connecting wire 25 and the winding in chamber 22*a* because there the voltage difference is a maximum as can be seen in FIG. 2**.

Figure 7:
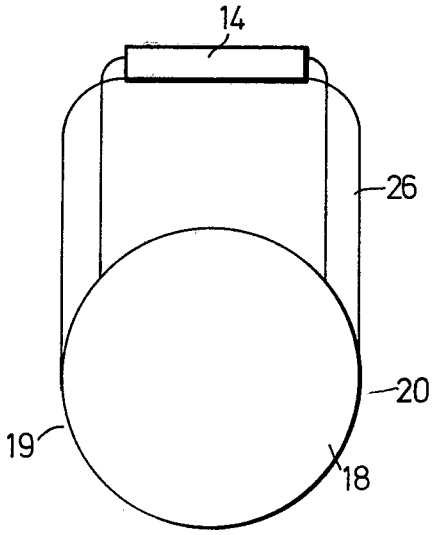
FIG. 7 is a simplified pictorial, axial end view of an advantageous form of construction for a coil body according to the invention.

In FIG. 7, the rectifier 14 is arranged, as in FIG. 5, at a location radially outwardly offset from windings 12 and 13 in order to improve the voltage stability. However, the chamber wall 19 does not here have a diameter, around the entire transformer circumference, larger than that of the remaining chamber walls 20. Rather, the chamber wall 19 is provided with a radially oriented projection 26 only at the point where rectifier 14 is located. Elsewhere, the chamber wall 19 has the same diameter as the remaining chamber walls 20.

The rectifier 14 is preferably mounted on the chamber wall 19 by means of a fastening device, e.g. a snap-in connection. When the rectifier 14 is so mounted, the relatively rigid connecting wires of the rectifier 14 can simultaneously serve as points of support for the relatively thin wire of the high voltage winding 12. Thus, during the winding process, the ends of the partial windings disposed in chambers 22 are connected directly with the connecting wires of the rectifier 14. Thus those connecting wires take over the function of pins which usually are provided at a coil body to serve as supports.

The primary 4, the high voltage windings 12 and 13 and the rectifiers 14 together are cast in a cast resin block and are thus encased on all sides in resin. This produces a voltage free and fireproof unit. The resin may, for example, be a thermosetting epoxy resin or a polyester resin.

The cast resin block containing the above-mentioned components then has four terminals, i.e. the terminals for the primary 4, the output providing the high voltage c of FIG. 1, and the output for the lower end of the winding 13 which is grounded when the transformer is installed.

A transformer according to the invention could, if desired, be provided with further windings, such as auxiliary windings for generating retrace pulses, wound around core arm 15.

The chambers 22 may have a maximal depth of 3 mm and a width of 1 mm. The width of each wall 20 is 0.8 mm and width of wall 19 is about 3 mm. Width of primary winding may be 0.5 mm and diameter of core arm 15 about 15 mm. The number of turns is 100 in primary winding 4 and 2700 in windings 12 and 13 together. Wire diameter is 0.2 mm for winding 4 and 0.07 mm for windings 12,13.

It is to be understood that the above description of the present invention is susceptible to various modifications, changes and adaptations, and the same are intended to be comprehended within the meaning and range of equivalents of the appended claims.

We claim:

1. In a horizontal deflection circuit output transformer for a television picture tube having an anode, which transformer includes a primary coil, a secondary coil inductively coupled to the primary coil, and rectifier means connected to the secondary coil and cooperating therewith to generate a high voltage for the picture tube anode, the improvement wherein: said secondary coil is divided to consist of only two partial windings; said rectifier means is located physically, and connected electrically, exclusively between said partial windings; the end of one said partial winding remote from said rectifier means is connected to ground; and the end of the other said partial winding remote from said rectifier means is arranged for direct conductive connection to the picture tube anode.

2. Transformer as defined in claim 1 wherein said two partial windings are electrically and physically of the same size.

3. Transformer as defined in claim 1 wherein there are two said rectifiers connected in series between said partial windings.

4. Transformer as defined in claim 1 further comprising a core composed of a plurality of arms connected together in the form of a frame, with said two coils being wound one on top of the other around one of said arms.

5. Transformer as defined in claim 1 wherein said secondary coil is designed as a chamber coil.

6. Transformer as defined in claim 1 or 5 wherein said coils are wound to create an insulation distance between said primary and secondary coils, having a maximum midway between the ends of said secondary coil and decreasing toward said ends.

7. Transformer as defined in claim 6 comprising a coil form defining annular chambers in which said windings are disposed and having a wall located between said primary and secondary coils, said wall neing constructed to have a thickness which increases from the ends toward the center of said form.

8. Transformer as defined in claim 5 comprising a coil form defining annular chambers in which said windings are disposed and which present rounded bottoms.

9. Transformer as defined in claim 8 wherein said form additionally defines two additional annular chambers at the ends of said form having bottoms configured differently from those of said first-recited chambers.

10. Transformer as defined in claim 9 wherein said annular chambers are divided into two groups each containing a respective partial winding, with said rectifier being located between said two groups, and said chamber of each said group closest to said rectifier has a rounded bottom with a larger radius of curvature than said bottoms of the other chamber of said group.

11. Transformer as defined in claim 10 wherein said chamber at one end of each said group is not filled with a portion of its associated partial winding.

12. Transformer as defined in claim 1 wherein said coils have cylindrical forms, said secondary coil is wound around said primary coil, and said primary coil extends axially beyond said secondary coil.

13. Transformer as defined in claim 1 further comprising a coil form defining annular chambers in which said windings are disposed, with said chambers associated with each said winding being filled to respectively different levels for tuning said secondary coil to the frequency of the line retrace oscillation of said receiver.

14. Transformer as defined in claim 1 further comprising a cylindrical coil form presenting a plurality of annular chamber walls spaced apart in the direction of the axis of said form, one of said walls being located to divide said chambers into two equal groups and having a diameter and thickness greater than those of the other said walls, said rectifier being mounted on the outer circumferential surface of said one wall.

15. Transformer as defined in claim 14 wherein said one chamber wall has such larger diameter over only a portion of its circumference and over the remaining portion of its circumference has the same diameter as the other said walls.

16. Transformer as defined in claim 14 wherein said rectifier is oriented obliquely with respect to the circumferential direction of said one wall.

17. Transformer as defined in claim 14 wherein said one wall comprises receiving and fastening means for holding said rectifier, said rectifier includes connecting wires, each said partial winding of said secondary coil comprises a wire end connected directly with a respective connecting wire of said rectifier.

18. Transformer as defined in claim 1 further comprising a core and wherein said secondary coil is wound around said core and has the form of a chamber coil with each partial winding disposed in a plurality of chambers spaced apart along said core, said chambers being associated with each said partial winding being formed assymetrically with respect to said core and each said partial winding being spaced from said core in an optimum manner with respect to the voltage load on said secondary coil.

19. Transformer as defined in claim 1 further comprising a core on which said coils are mounted, and an additional coil mounted on said core.

20. Transformer as defined in claim 1 further comprising a cast resin mass encasing said coils and said rectifier.

21. Transformer as defined in claim 20 wherein said resin mass is composed of a thermosetting epoxy resin or a polyester resin.

22. Transformer as defined in claim 1 further comprising means connected to said end of the other said partial winding remote from said rectifier for effecting a conductive, non-rectifying connection of that said end of said other partial winding to the picture tube anode, so that the high voltage for the anode is present at that said end of the other said partial winding.

* * * * *